US007798203B2

(12) United States Patent
Schweigert et al.

(10) Patent No.: US 7,798,203 B2
(45) Date of Patent: Sep. 21, 2010

(54) GOLF CLUB HEAD HAVING A CROWN WITH THIN REGIONS

(75) Inventors: Bradley D. Schweigert, Phoenix, AZ (US); John C. Bliss, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 107 days.

(21) Appl. No.: 12/245,913

(22) Filed: Oct. 6, 2008

(65) Prior Publication Data

US 2009/0031551 A1 Feb. 5, 2009

Related U.S. Application Data

(63) Continuation of application No. 11/516,373, filed on Sep. 6, 2006, now Pat. No. 7,448,964.

(51) Int. Cl.
*B22C 9/00* (2006.01)
*B22D 19/00* (2006.01)

(52) U.S. Cl. ..... 164/516; 164/47

(58) Field of Classification Search ..... 164/516, 164/47

See application file for complete search history.

(56) References Cited

U.S. PATENT DOCUMENTS

| | | | | |
|---|---|---|---|---|
| 4,214,754 | A | 7/1980 | Zebelean | |
| 5,067,715 | A | 11/1991 | Schmidt et al. | |
| 5,954,596 | A | 9/1999 | Noble et al. | |
| 6,027,416 | A | 2/2000 | Schmidt et al. | |
| 6,776,723 | B2 | 8/2004 | Bliss | |
| 6,783,465 | B2 * | 8/2004 | Matsunaga | 473/329 |
| 6,852,038 | B2 * | 2/2005 | Yabu | 473/224 |
| 7,051,416 | B2 * | 5/2006 | Yabu | 29/527.6 |
| 7,074,136 | B2 * | 7/2006 | Noguchi et al. | 473/346 |
| 7,448,964 | B2 * | 11/2008 | Schweigert et al. | 473/345 |
| 2003/0104878 | A1 * | 6/2003 | Yabu | 473/345 |

* cited by examiner

*Primary Examiner*—Kevin P Kerns

(57) ABSTRACT

A method of casting a hollow golf club head includes casting the crown with a plurality of thin regions having a thickness of less than 0.030 inch separated by a plurality of ribs. The ribs act as cast-in runners that enable the thin sections to be formed without voids despite the extremely thin cross-section. The crown may have an additional region of substantially uniform thickness that is substantially the same as the thickness of the ribs.

20 Claims, 2 Drawing Sheets

12
10
14
16
17
20
22
28
30
34
35
38
40
42
24
26
32

GOLF CLUB HEAD HAVING A CROWN WITH THIN REGIONS

This application is a continuation application claiming priority of U.S. application Ser. No. 11/516,373 filed Sep. 6, 2006, now U.S. Pat. No. 7,448,964.

BACKGROUND OF THE INVENTION

The present invention relates generally to golf equipment and, in particular, to a golf club head having a crown with thin regions.

U.S. Pat. No. 5,954,596 to Noble et al discloses a golf club head including a hollow body with a front wall, a top wall or crown, a bottom wall or sole, and a side wall or skirt. The front wall varies in thickness while the top, bottom and side walls are substantially uniform in thickness.

U.S. Pat. No. 6,776,723 to Bliss et al discloses a golf club head including a hollow body with a front wall, a top wall, a bottom wall and a side wall as disclosed in the Noble et al patent. The front wall varies in thickness, and a weight member located on the sole lowers the center of gravity of the club head.

DESCRIPTION OF THE INVENTION

Figures 1, 2, 3:
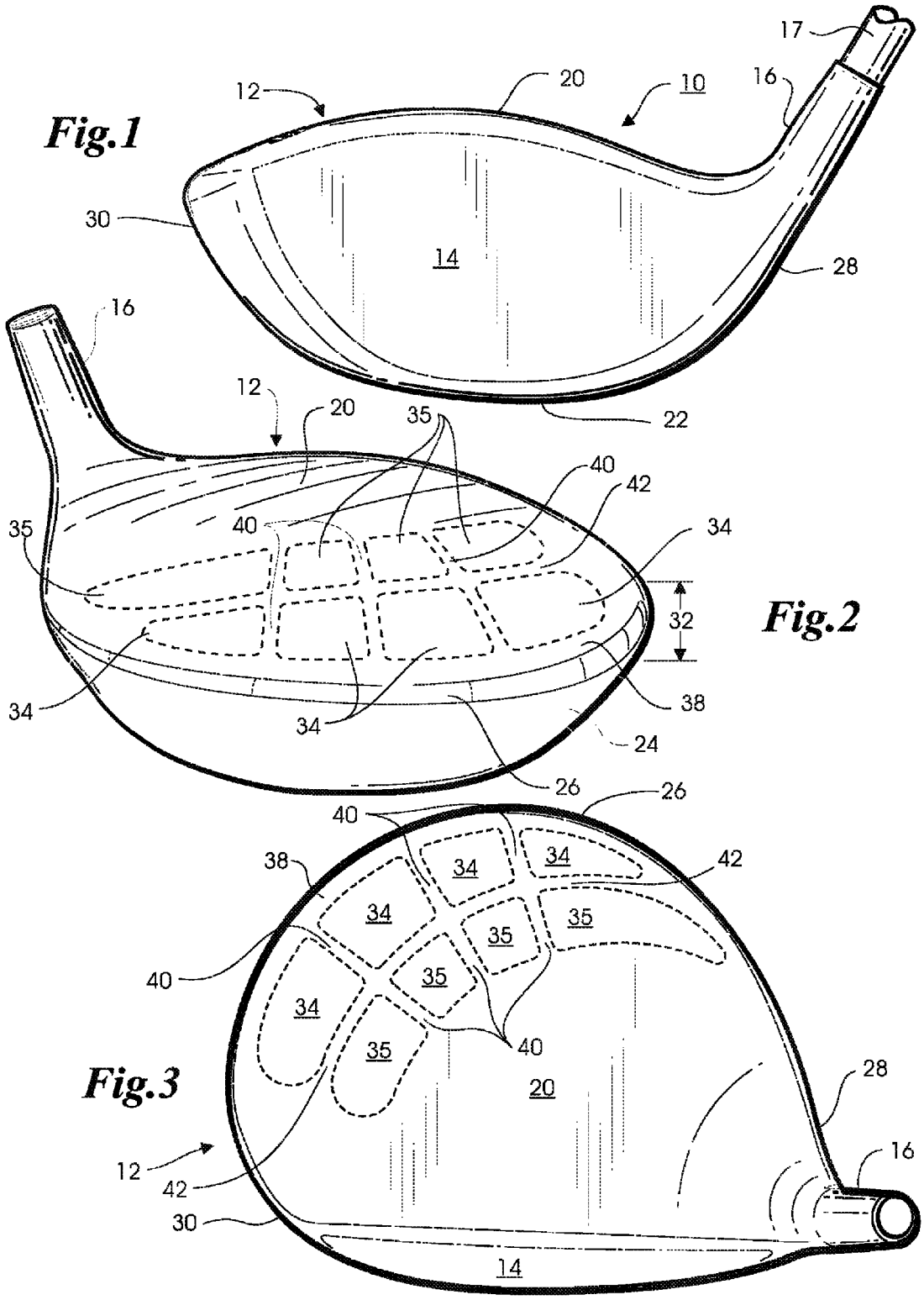
FIG. 1 is a front elevation view of a golf club head according to one embodiment of the present invention.
FIG. 2 is a rear perspective view of the golf club head of FIG. 1.
FIG. 3 is a top view of the golf club head of FIG. 1.

With reference to FIGS. 1-3, a golf club head 10 comprises a hollow body 12 preferably formed of titanium having a front wall 14 for impacting a golf ball, and a hosel 16 adapted to receive a golf club shaft 17. Hollow body 12 further includes a crown 20, a sole 22 and a skirt 24. The crown 20 extends rearwardly from an upper portion of the front wall 14, and the sole 22 extends rearwardly from a lower portion of the front wall 14. Crown 20 and skirt 24 meet along an outer edge 26 of the crown 20 which, preferably, extends in an arcuate path between a heel end 28 of hollow body 12 and a toe end 30 of hollow body 12. The skirt 24 extends from the crown outer edge 26 toward the sole 22. The crown 20 has a thickness dimension measured between its inner and outer surfaces.

The region surrounding crown outer edge 26 preferably forms an outer perimeter region 32 that smoothly blends crown 20 and skirt 24 together. Outer perimeter region 32 preferably ranges from about 0.700 inch above and about 0.700 inch below the crown outer edge 26, more preferably about 0.350 inch above and about 0.350 inch below the crown outer edge 26, and most preferably about 0.250 inch above and about 0.250 inch below the crown outer edge 26.

Hollow body 12 may be formed by investment casting or it may be assembled from a series of forged pieces that are welded or brazed together. Crown 20 is formed with a plurality of thin regions 34, 35 arranged in a web-shaped pattern. The plurality of thin regions 34, 35 includes a first row of thin regions 34 disposed adjacent the crown outer edge 26, and a second row of thin regions 35 disposed inwardly of the first row of thin regions 34.

The first row of thin regions 34 is spaced from the crown outer edge 26 to form a substantially arcuate rib 38 that extends along the outer perimeter region 32. In addition, the thin regions 34 and 35 are spaced apart to form substantially linear ribs 40 that are connected to the arcuate rib 38. The first and second rows of thin regions 34, 35 are spaced apart to form a substantially arcuate rib 42 disposed radially inward from arcuate rib 38. The arcuate ribs 38, 42 and the linear ribs 40 define the web-shaped pattern in which the thin regions 34, 35 are arranged while maintaining the strength of the crown 20.

The thin regions 34, 35 are formed such that the thickness dimension of the crown 20 in the thin regions 34, 35 is reduced when compared with the thickness dimension of the crown 20 in other regions of the crown 20. The approximate thickness dimension of the thin regions 34, 35 may range from 0.016 to 0.030 inch, or more preferably from 0.018 to 0.028 inch, and most preferably from 0.020 to 0.026 inch. Other regions of the crown 20 have a thickness dimension greater than 0.030 inch.

The web-shaped pattern in which the thin regions 34, 35 are arranged removes approximately 3 grams of unneeded material in the crown 20. The material removed from the crown 20 is preferably redistributed to the sole 22 thereby lowering the center of gravity of the club head 10 approximately 0.020 inch toward the sole 22.

Figure 4:
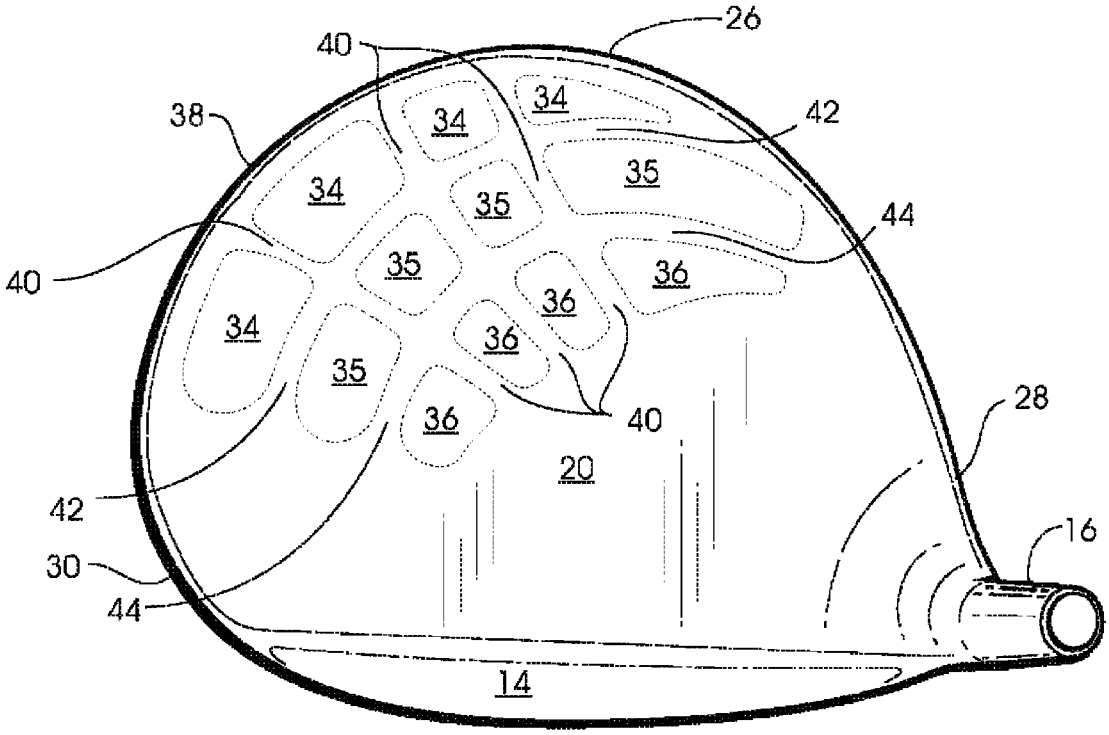
FIG. 4 is a top view of a golf club head according to another embodiment of the present invention.

In the embodiment of the golf club head 10 shown in FIG. 4, a third row of thin regions 36 is disposed inwardly of the second row of thin regions 35. A further substantially arcuate rib 44 is disposed radially inward from the arcuate rib 42 between the second and third rows of thin regions 35, 36.

As is well-known in the art, investment casting of thin-wall sections presents special difficulties since the rapidly-cooling metal tends to solidify in the thin-wall areas of the mold. The solidified metal prevents complete filling of the mold thereby causing voids in the finished part. Consequently, conventional investment casting methods cannot reliably produce a large (e.g. 460 cc) titanium alloy driver with a crown less than 0.030 inch thick. Without being held to a particular theory of operation, it is believed that the linear ribs 40 and the arcuate ribs 42 act as cast-in runners enabling the molten metal to fully fill-in the thin sections despite the large thin wall comprising the crown.

What is claimed is:

1. A method of manufacturing a golf club head comprising:

casting a golf club head body from a molten metallic alloy, the golf club head body comprising a hollow shell having a heel end, a toe end, a front wall, a sole and a unitary metallic crown having an inner surface and an outer surface, the unitary metallic crown comprising a first region having a plurality of thin regions and a plurality of ribs, wherein each thin region of the plurality of thin regions has a thickness of less than 0.030 inches measured between the inner surface and the outer surface, and wherein each thin region of the plurality of thin regions is separated from an adjacent thin region by one of the plurality of ribs, each rib of the plurality of ribs having a thickness greater than the thickness of each thin region of the plurality of thin regions.

2. The method of claim 1, wherein:

casting the golf club head body comprises investment casting the golf club head body.

3. The method of claim 1, wherein:

each thin region of the plurality of thin regions has a thickness of less than 0.028 inch.

4. The method of claim 1, wherein:

each thin region of the plurality of thin regions has a thickness of from 0.016 to 0.028 inch.

5. The method of claim 1, wherein:

the crown further comprises a second region disposed away from the plurality of thin regions, the second region having a substantially uniform thickness equal to the thickness of the plurality of ribs.

6. The method of claim 5, wherein, the second region comprises a perimeter region surrounding the thin regions.

7. The method of claim 1, wherein:

the plurality of thin regions are arranged to form a plurality of rows of thin regions and the plurality of ribs are arranged to form an arcuate rib separating each row of the plurality of rows of thin regions from an adjacent row and a substantially linear rib separating each thin region from an adjacent thin region.

8. The method of claim 1, wherein:

the unitary metallic crown is substantially free of voids.

9. A method of manufacturing a golf club comprising:

casting a golf club head body from a molten metallic alloy, the golf club head body comprising a hollow shell having a heel end, a toe end, a front wall, a sole and a unitary metallic crown having an inner surface and an outer surface, the unitary metallic crown comprising a first region having a plurality of thin regions and a plurality of ribs, wherein each thin region of the plurality of thin regions has a thickness of less than 0.030 inches measured between the inner surface and the outer surface and wherein each thin region of the plurality of thin regions is separated from an adjacent thin region by one of the plurality of ribs, each rib of the plurality of ribs having a thickness greater than the thickness of each thin region of the plurality of thin regions; and attaching a golf club shaft to the golf club head body.

10. The method of claim 9, wherein:

casting the golf club head body comprises investment casting the golf club head body.

11. The method of claim 9, wherein:

each thin region of the plurality of thin regions has a thickness of less than 0.028 inch.

12. The method of claim 9, wherein:

each thin region of the plurality of thin regions has a thickness of from 0.016 to 0.028 inch.

13. The method of claim 9, wherein:

the crown further comprises a second region disposed away from the plurality of thin regions, the second region having a substantially uniform thickness equal to the thickness of the plurality of ribs.

14. The method of claim 13, wherein, the second region comprises a perimeter region surrounding the thin regions.

15. The method of claim 9, wherein:

the plurality of thin regions are arranged to form a plurality of rows of thin regions and the plurality of ribs are arranged to form an arcuate rib separating each row of the plurality of rows of thin regions from an adjacent row and a substantially linear rib separating each thin region from an adjacent thin region.

16. The method of claim 9, wherein:

the unitary metallic crown is substantially free of voids.

17. A method of manufacturing a golf club head comprising:

casting a golf club head body from a molten metallic alloy, the golf club head body comprising a hollow shell having a heel end, a toe end, a front wall, a sole and a substantially solid, unitary metallic crown having an inner surface and an outer surface, the unitary metallic crown comprising a first region and a second region, the first region having a thickness of less than 0.030 inch measured between the inner surface and the outer surface and the second region having a thickness of at least 0.030 inch measured between the inner surface and the outer surface.

18. The method of claim 17, wherein:

the second region intersects at least a portion of the first region.

19. The method of claim 17, wherein:

the second region surrounds at least a portion of the first region.

20. The method of claim 17, wherein:

the first region has a thickness of from 0.016 to 0.028 inch.

* * * * *